United States Patent [19]

Langenbeck et al.

[11] Patent Number: 4,799,978

[45] Date of Patent: Jan. 24, 1989

[54] ALUMINUM ALLOY

[75] Inventors: Sharon L. Langenbeck, Newhall, Calif.; Gregory J. Hildeman, Murraysville, Pa.

[73] Assignee: Lockheed Corporation, Calabasas, Calif.

[21] Appl. No.: 105,962

[22] Filed: Oct. 2, 1987

Related U.S. Application Data

[63] Continuation of Ser. No. 871,191, Jun. 5, 1986, abandoned, which is a continuation-in-part of Ser. No. 714,765, Mar. 22, 1985.

[51] Int. Cl.[4] ..... C22C 21/00

[52] U.S. Cl. ..... 148/437; 75/249

[58] Field of Search ..... 420/550; 148/437; 75/249

[56] References Cited

U.S. PATENT DOCUMENTS

| | | | |
|---|---|---|---|
| 2,963,780 | 12/1960 | Lyle et al. | 29/182 |
| 3,899,820 | 8/1975 | Read et al. | 29/420.5 |
| 4,104,061 | 8/1978 | Roberts | 75/211 |
| 4,347,076 | 8/1982 | Ray et al. | 75/0.5 R |

*Primary Examiner*—R. Dean

*Attorney, Agent, or Firm*—Louis L. Dachs

[57] ABSTRACT

The aluminum alloy comprises by weight 81 to 91.8 percent aluminum, 4 to 8 percent iron, 4 to 8 percent nickel and 0.1 to 3 percent chromium. The preferred nominal composition is 86 percent aluminum, 6 percent iron, 6 percent nickel, and 2 percent chromium.

2 Claims, 5 Drawing Sheets

COMPARISON OF THE ALLOY TO Ti-6Al-4V
SPECIFIC STRENGTH AND SPECIFIC MODULUS

| TEMPERATURE | DENSITY lb/in 3 | COMPRESSIVE YIELD STRENGTH ksi | COMPRESSIVE MODULUS Msi | TENSION MODULUS Msi | SPECIFIC STRENGTH COMPRESSIVE in | SPECIFIC MODULUS COMPRESSIVE in | SPECIFIC MODULUS TENSION in |
|---|---|---|---|---|---|---|---|
| Al-5.7Fe-5.7Ni-1.7Cr | | | | | | | |
| ROOM TEMP. | 0.107 | 80 | 12.0 | 13.8 | 748 | 112 | 129 |
| 450°F | 0.107 | 58 | 12.5 | 11.1 | 542 | 117 | 104 |
| 600°F | 0.107 | 56 | 12.3 | 8.0 | 523 | 115 | 75 |
| Ti-6Al-4V | | | | | | | |
| ROOM TEMP. | 0.160 | 140 | 16.4 | 16.0 | 875 | 103 | 100 |
| 450° F | 0.160 | 104 | 14.3 | 13.9 | 650 | 89 | 87 |
| 600° F | 0.160 | 95 | 13.4 | 13.1 | 593 | 84 | 82 |

Fig. 7.

ALUMINUM ALLOY

This is a continuation of co-pending application Ser. No. 871,191 filed on June 5, 1986, now abandoned which is a continuation-in-part of application Ser. No. 714,765, filed Mar. 22, 1985.

TECHNICAL FIELD

The invention relates to aluminum alloys and, in particular, to a new dispersion strengthened, aluminum alloy containing nickel, iron, and chromium, that can withstand extended, elevated temperature exposures of up to 800° F. and still retain excellent mechanical properties upon return to room temperature.

BACKGROUND ART

Dispersion strengthened aluminum alloys containing large volume fractions of finely dispersed, insoluble intermetallic particles can be produced by powder metallurgical techniques. Of interest is U.S. Pat. No. 2,963,780, "Aluminum Alloy Powder Product" by J.P. Lyle, Jr. et al. The Lyle et al. invention is directed to hot worked, dispersion hardened aluminum alloy compositions adapted for service at elevated temperatures. These aluminum alloys are produced by atomizing powders which contain very fine intermetallic particles preferably under 0.4 micrometers. The powder is subsequently compacted at high temperature and hot worked by extrusion processes. Thereafter it may be rolled or forged. Alloy compositions are claimed having iron contents of between 5 and 10% by weight, with at least one hardening element selected from the group composed of 0.1 to 10% manganese, 0.1 to 10% nickel, 0.1 to 10% cobalt, 0.1 to 10% chromium, 0.1 to 10% titanium, 0.1 to 10% zirconium, and 0.1 to 10% vanadium, with the total amounts of the hardening elements not exceeding 10% by weight. No example of an aluminum alloy having a nominal 6% iron, 6% nickel, and 2% chromium was discussed therein.

Another typical technique for making such alloys is disclosed in U.S. Pat. No. 3,899,820, "Method of Producing a Dispersion-Strengthened Aluminum Alloy" by P. J. Read, et al., (also herein incorporated by reference). Read, et al., discloses a method of spray casting wherein the atomized aluminum, in the form of a stream of molten alloy, is cooled by high-velocity jets of nitrogen or other suitable gases. The atomized molten droplets are carried to a moving substrate wherein, upon impact, they solidify at extremely high cooling rates as a result of initial gas cooling and secondary cooling from the substrate. In general, Read, et al., discloses the use of alumimun with 0.05 to 25% of alloying constituents. The amount of the alloying constituents is in excess of the equilibrium solubility. Of particular interest is their disclosure of aluminum alloys containing 3 to 15% of transition metals comprising titanium, vanadium, chromium, magnesium, iron, cobalt, nickel, zirconium, niobium, and molybdenum. P. J. Read et al. particularly emphasizes the fact that the process allows the alloying additions to be retained in the super-saturated solid solution or dispersed in very fine, less-than-one micrometer, particles which are beneficial for dispersion strengthening.

While the above alloys disclosed in the reference patent have shown good strength up to 600° F., above this temperature there remains a need for alloys which exhibit good strength. Also of interest is U.S. Pat. No. 4,347,076, "Aluminum-Transition Metal Alloys Made Using Rapidly Solidified Powders and Method" by Ranjan Ray et al. and U.S. Pat. No. 4,104,061, "Powder Metallurgy" by S. Roberts.

What is important about these alloys is that they cannot be made by the more conventional ingot-casting processes in that the alloy ingredients tend to segregate into coarse constituents during solidification. The coarse intermetallic phases do not substantially contribute to strengthening of the alloy due to a large particle size and spacing. Generally, for dispersion strengthened alloys, particle spacings of one micrometer or less, are effective in increasing the strength of the matrix. In addition, retention of room temperature and elevated temperature strength upon elevated temperature exposure is desirable in aluminum alloys.

Therefore, it is a primary object of the subject invention to provide an aluminum alloy that has good mechanical properties up to 800° F.

Another object of the subject invention is to provide an aluminum alloy that retains substantially all its room temperature mechanical properties after extended exposure to temperatures up to and including 800° F.

It is further object of the subject invention to provide an aluminum alloy having superior compression strength in the 600° F. temperature range, compared to existing dispersion strengthened aluminum alloys.

DISCLOSURE OF INVENTION

The aluminum alloy essentially comprises 81 to 91.9% aluminum, 4.0 to 8.0% iron, 4.0 to 8.0% nickel, and 0.1 to 3.0% chromium. The preferred nominal alloy content is 6% iron, 6% nickel and 2% chromium with the remainder aluminum. The alloy has been fabricated by consolidating the atomized powder and hot extruding into a rectangular bar. Extensive testing of this alloy has demonstrated a unique combination of mechanical properties which are believed to have not been previously achieved. A yield strength of over 78,000 psi and ultimate strength 84,000 psi and an elastic modulus of 13.8 million pounds per square inch at room temperature have been obtained for an alloy having 86.9% Al, 5.7% Fe, 5.7% Ni, and 1.7 Cr. In addition, this alloy has demonstrated excellent strength after exposures at temperatures up to and including 800° F. An ultimate strength of 14,000 psi with a 30% elongation has been obtained at 800° F.

The novel features which are believed to be characteristic to the invention, both as to its organization and method of operation, together with further objects and advantages thereof, will be better understood from the following description.

BRIEF DESCRIPTION OF THE DRAWINGS

Illustrated in FIG. 1 is a graph of the room and elevated temperature ultimate tension strength for four alloys.

Illustrated in FIG. 2 is a graph of the room and elevated temperature yield strength for four alloys.

Figure 3:
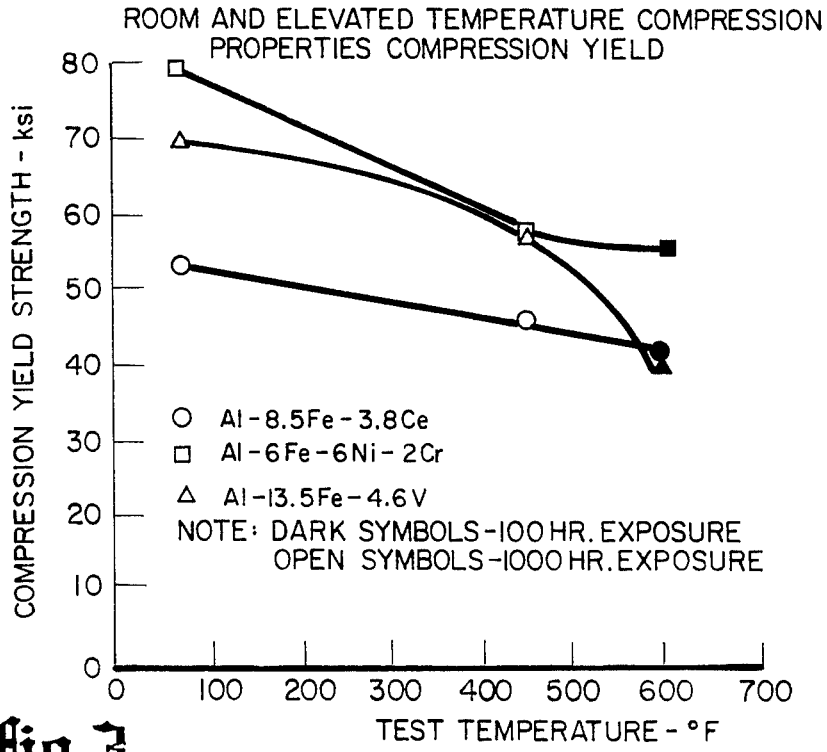

Illustrated in FIG. 3 is a graph of the room and elevated temperature compression yield for three alloys.

Figure 4:
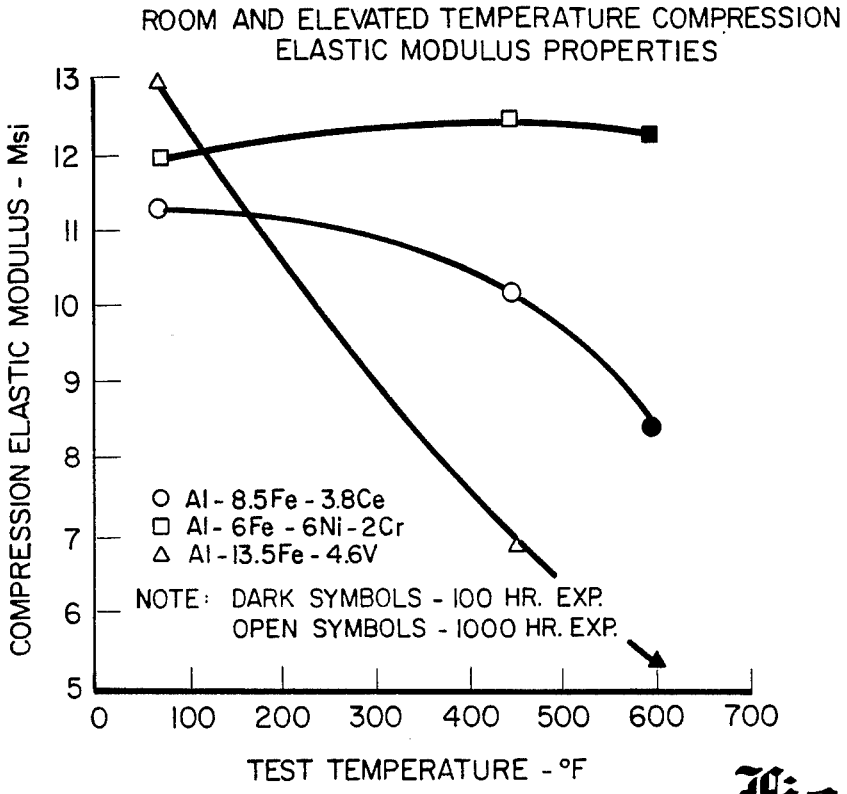

Illustrated in FIG. 4 is a graph of the room and elevated temperature compression elastic modulis for three alloys.

Figure 5:
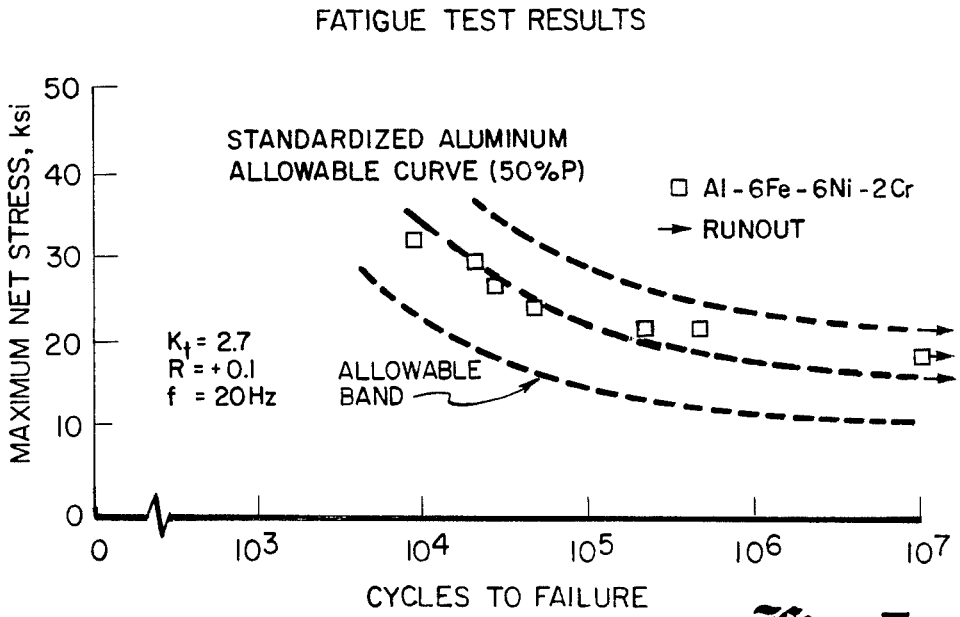

Ilustrated in FIG. 5 is a graph of the room temperature fatigue properties for the alloy.

Figure 6:
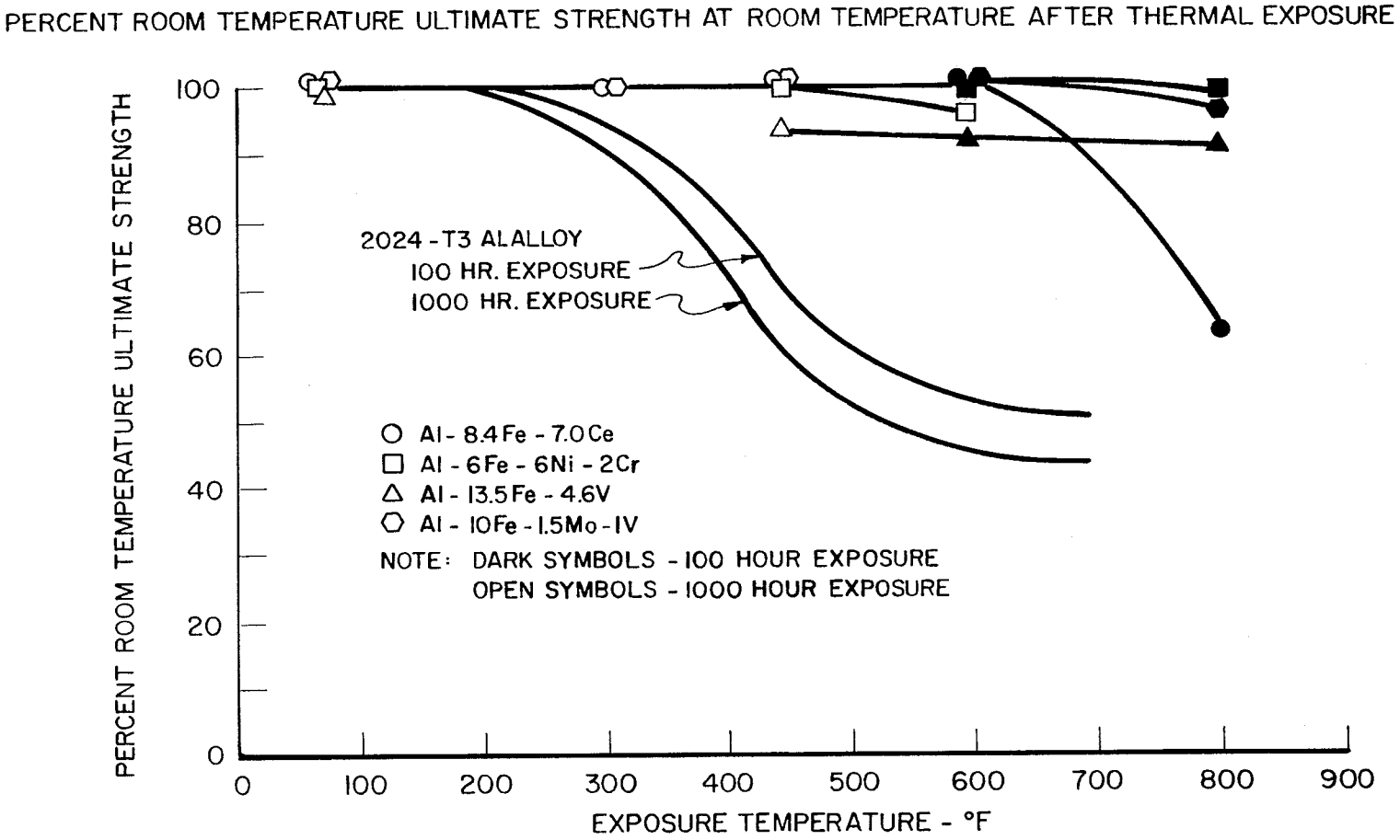

Illustrated in FIG. 6 is a graph of the percent room temperature ultimate strength at room temperature after thermal exposure.

Illustrated in FIG. 7 is a table comparing the specific properties of the subject aluminum alloy to titanium.

BEST MODE FOR CARRYING OUT THE INVENTION

Using the nominal values of the alloy ingredients, i.e., Al-6Fe-6Ni-2Cr, a 78,000 psi yield strength, an ultimate strength of 84,000 psi, and an elastic modulus of 13.8 million psi has been obtained at room temperature. Similar performance can be obtained with an alloy compositions between 4 to 8 percent iron, 4 to 8 percent nickel, and 0.1 to 3 percent chromium are believed to result in superior combinations of strength and elastic modulus at room and elevated temperatures up to at least 800° F.

The range of composition is included because alloys fabricated with these compositions would possess essentially the same microstructure and, therefore, beneficial properties of nominal Al-6Fe-6Ni-2Cr. In addition, all alloy specifications include a range of composition due to processing variabilities. Alloys containing less than the range of composition would not produce sufficient dispersoids for the alloy to possess optimum properties. Alloys with more constituents than the range given would not be useful in an engineering application due to limited ductility.

The alloy may be fabricated by using splat or conventional powder atomization and consolidation procedures previously mentioned in U.S. Pat. Nos. 3,899,820, "Method of Producing a Dispersion-Strengthened Aluminum Alloy" by P. J. Read, et al., and 2,963,780, "Aluminum Alloy Powder Product" by J. P. Lyle, Jr., et al. Additional methods are disclosed in U.S. Pat. No. 4,379,719, "Aluminum Powder Alloy Product for High Temperature Application" and U.S. Pat. No. 4,464,199, "Aluminum Powder Alloy Product for High Temperature Application" both by G. J. Hildeman, et al.

SUMMARY OF TEST RESULTS ON ALLOY

Microstructural examination of the alloy revealed the microstructure was uniform with well-dispersed fine particles. A typical alloy composition was found to be 5.74% Fe, 5.73% Ni, 1.7% Cr, balance Al and trace elements.

X-ray analysis of the alloy has indicated that two distinct phases exist, Al7Cr and Al9(Fe,Ni)2, which establishes that the additions of Chromium have a decided effect on the physical properties of the alloy.

Mechanical property testing of the alloy was conducted according to the appropriate ASTM Standards. Table 1 is a comparison of tension properties of Al-6Fe-6Ni composition with and without Cr at 650° F. after a 1,000 hour exposure to that temperature. The results show that the addition of Cr substantially improves elevated temperature strength.

TABLE 1

COMPARISON OF TENSION PROPERTIES AT 650° F. AFTER 1,000 HR. EXPOSURE AT 650° F.

| Alloy Composition (wt. %) | Ultimate Strength (psi) | Yield Strength (psi) | Elongation (%) |
|---|---|---|---|
| Al—6Fe—6Ni* | $20.9 \times 10^3$ | $16.3 \times 10^3$ | 5.5 |
| Al—6Fe—6Ni—2Cr | $23.9 \times 10^3$ | $18.9 \times 10^3$ | 7 |
| | 14.4% increase | 16% increase | 27.3% |

TABLE 1-continued

COMPARISON OF TENSION PROPERTIES AT 650° F. AFTER 1,000 HR. EXPOSURE AT 650° F.

| Alloy Composition (wt. %) | Ultimate Strength (psi) | Yield Strength (psi) | Elongation (%) |
|---|---|---|---|
| | | | increase |

*AFWAL Report TR-81-4076

Figure 1:
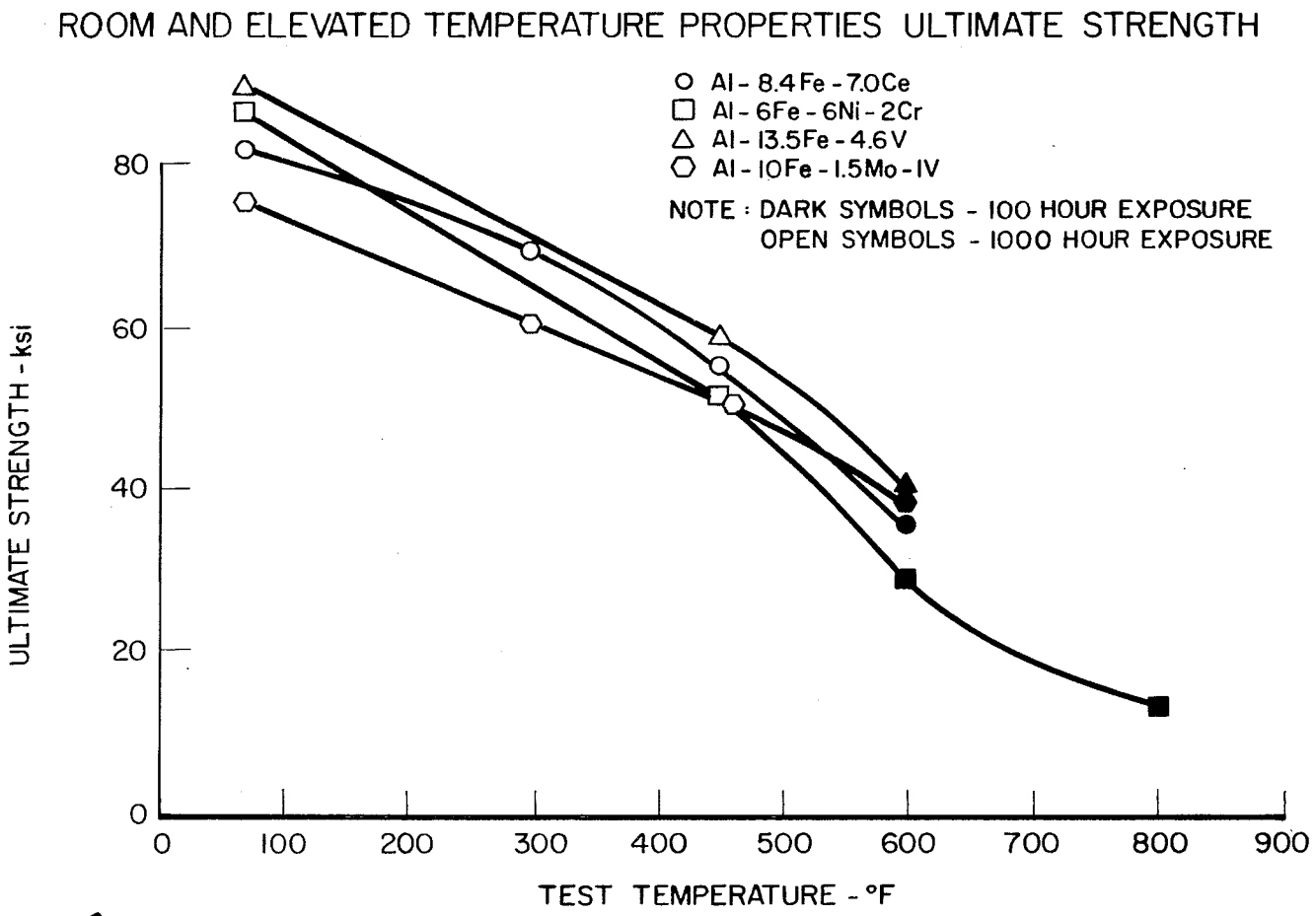
Figure 2:
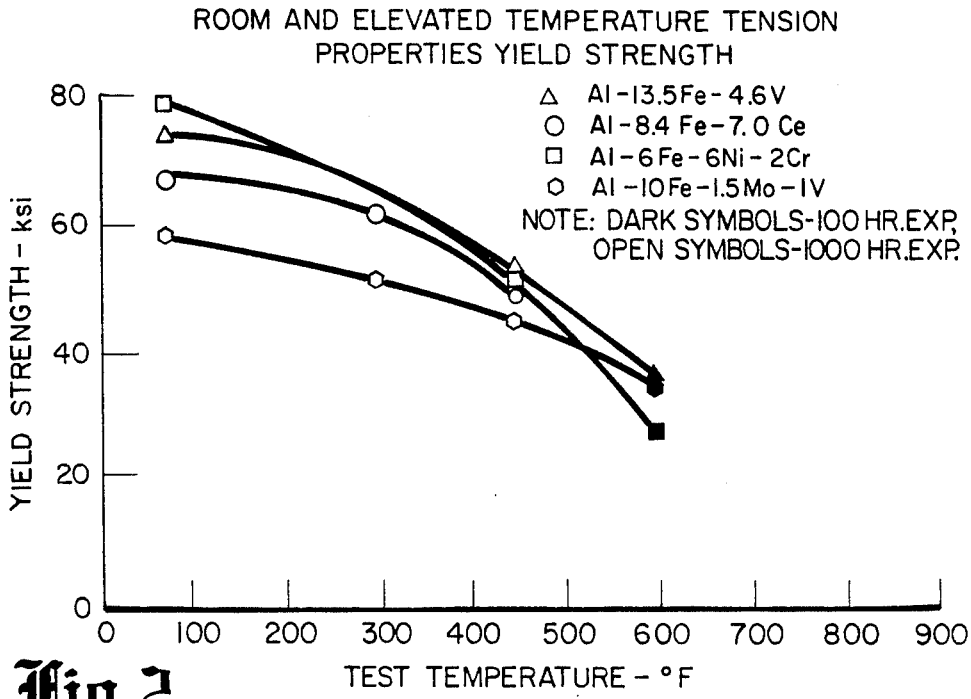

The results of the room and elevated temperature (450° F., 600° F., 800° F.) tension tests are presented in Table 2. Longitudinal with selected transverse testing was conducted. The results are averaged of triplicate tests except as indicated in the table. The room temperature strength and modulus were excellent for this alloy, with ductility being somewhat low. A comparison of room and elevated temperature tension properties of the subject alloy and other available high-temperature aluminum alloys are presented in FIG. 1 (Ultimate Strength), FIG. 2 (Yield Strength).

TABLE 2

ROOM AND ELEVATED TEMPERATURE TENSION PROPERTIES OF THE ALLOY

| Test Temp. | Exposure Conditions | Test Direction | Ultimate Strength, ksi | Yield Strength 0.2% Offset, ksi | Elastic Modulus, Msi | Elongation in 1 inch, % |
|---|---|---|---|---|---|---|
| Room Temp. | — | L | 86.5 | 79.3 | 13.8 | 3 |
| | | T | 84.7 | 72.6 | 13.4 | 3 |
| 450° F. | ½ hr at 450° F. | L + | 52.1 | 45.1 | 10.1 | 2 |
| | 1000 hrs at 450° F. | L | 52.6 | 46.9 | 11.1 | 3 |
| | | T | 51.7 | 48.1 | 10.3 | 2 |
| 600° F. | ½ hr at 600° F. | L + | 31.4 | 26.5 | 8.0 | 3 |
| | | T + | 35.0 | 27.0 | 8.9 | 3 |
| | 100 hrs at 600° F. | L | 32.3 | 27.8 | 9.1 | 3 |
| | | T | 33.5 | 28.4 | 8.7 | 3 |
| 800° F. | ½ hr at 800° F. | L + | 13.1 | — | — | 39 |
| | 100 hrs at 800° F. | L + | 13.6 | — | — | 30 |

+ Averages of duplicate testing

The compression test results are presented in Table 3. Longitudinal with selected transverse testing was conducted. The results are averages of triplicate tests except as indicated in the table. The compression yield strength of this alloy is superior to the other alloy systems evaluated at elevated temperatures. In addition, the alloy retains its compression modulus at the elevated temperatures after longtime exposure. Comparing the short and longtime exposure at 600° F., both the longitudinal and transverse longtime exposure properties were higher than after short time exposure. The high compression yield strength and modulus are excellent from an applications viewpoint.

TABLE 3

ROOM AND ELEVATED TEMPERATURE COMPRESSION PROPERTIES OF THE ALLOY

| Test Temperature | Exposure Conditions | Test Direction | Yield Strength 0.2% Offset, ksi | Elastic Modulus, Msi |
|---|---|---|---|---|
| Room Temp. | — | L | 79.6 | 11.9 |
| | | T | 80.5 | 12.4 |
| 450° F. | ½ hr at 450° F. | L + | 58.2 | 11.9 |
| | 1000 hrs at 450° F. | L | 57.6 | 12.5 |
| | | T | 67.9 | 12.4 |
| 600° F. | ½ hr at 600° F. | L | 50.4 | 11.0 |

TABLE 3-continued

ROOM AND ELEVATED TEMPERATURE COMPRESSION PROPERTIES OF THE ALLOY

| Test Temperature | Exposure Conditions | Test Direction | Yield Strength 0.2% Offset, ksi | Elastic Modulus, Msi |
|---|---|---|---|---|
| | | T + | 41.4 | 11.2 |
| | 100 hrs as 600° F. | L | 56.2 | 12.3 |
| | | T | 48.4 | 11.9 |

+ Averages of duplicate testing

Illustrated in FIGS. 4 and 5 are room and elevated temperature compressive properties, in particular, FIG. 4 presents compression yield and FIG. 5 presents compression elastic modulus of the subject alloy compared to other presently available alloys. Note particularly here in these two graphs, the superior performance of the subject alloy, particularly at 600° F.

Both room temperature tension and compression tests were conducted on material exposed to temperatures, up to 800° F. exposed material. The averages of duplicate tension test results are presented in Table 4. No loss in tensile strength was observed except for the material which was exposed for 100 hours at 800° F. For this condition, only yield strength slightly decreased while modulus and elongation retained its pre-exposed properties. Therefore, a superior thermal stability exists for this alloy system compared to other Al-Fe alloys. The room temperature compression test results (averages of duplicate specimens) after longtime exposure are presented in Table 5. For the conditions evaluated, no loss in compression yield or modulus was observed.

TABLE 4

ROOM TEMPERATURE LONGITUDINAL TENSION PROPERTIES AFTER ELEVATED TEMPERATURE EXPOSURE
Test Temperature is at Room Temperature

| Exposure Conditions | Ultimate Strength, ksi | Yield Strength 0.2% Offset, ksi | Elastic Modulus, Msi | Elongation in 1 inch, % |
|---|---|---|---|---|
| — | 86.5 | 79.3 | 13.8 | 3 |
| 1000 hrs at 450° F. | 84.8 | 78.5 | 14.5 | 4 |
| 100 hrs at 600° F. | 85.8 | 79.8 | 12.7 | 3 |
| 1000 hrs at 600° F. | 84.2 | 78.0 | 12.5 | 2 |
| 100 hrs at 800° F. | — | 75.4 | 13.2 | 2 |

Note: All results averages of duplicate tests except for the unexposed test results.

TABLE 5

ROOM TEMPERATURE LONGITUDINAL COMPRESSION PROPERTIES AFTER ELEVATED TEMPERATURE EXPOSURE
Test Temperature is at Room Temperature

| Exposure Conditions | Yield Strength 0.2% Offset, ksi | Elastic Modulus, Msi |
|---|---|---|
| — | 79.6 | 11.9 |
| 1000 hrs at 450° F. | 77.1 | 12.7 |
| 100 hrs at 600° F. | 78.1 | 12.1 |

Note: All results averages of duplicate tests except for the unexposed test results.

Room temperature fatigue testing was also conducted. Testing was conducted using a stress ratio of +0.1 and a frequency of 20 Hz. The tabulated results of the fatigue testing are presented in Table 6. The results are similar to that obtained with conventional aluminum ingot materials as illustrated in FIG. 5. Note that the fatigue results are generally comparable with other aluminum alloys.

TABLE 6

ROOM TEMPERATURE FATIGUE TEST RESULTS FOR ALUMINUM ALLOY

| Maximum Net Stress, ksi | Cycles to Failure |
|---|---|
| 17.5 | $1 \times 10^7$ (runout) |
| 20.0 | 725,127 |
| 22.5 | 6,376,840 |
| 25.0 | 27,488 |
| 27.5 | 15,899 |
| 30.0 | 7,754 |
| 32.5 | 3,966 |

Presented in FIG. 6 is a comparison of the percent of room temperature ultimate strength at room temperature after thermal exposure of the subject alloy with various prior art high temperature Al alloys. Note that the subject alloy compares favorably with all of the prior art alloys. Additionally, for comparison purposes, data on a conventional high strength Al alloy (2024) is presented.

The Al-6Fe-6Ni-2Cr alloy also has potential to replace titanium in compression dominated and modulus or stiffness dominated structure. This is demonstrated by the specific strength and specific modulus values presented in FIG. 7.

To demonstrate the lower limits of the constituents of the Al-Fe-Ni-Cr alloy, an alloy of the following composition was fabricated: Al-4.7Fe-4.7Ni-0.2Cr. This alloy was fabricated similarly to the Al-5.7Fe-5.7Ni-1.7Cr by consolidating the atomized powder and hot extruding into a rectangular bar. Table 7 presents the room and elevated temperature tension properties for the rectangular bar. The stability of the Al-4.7Fe-4.7Ni-0.2Cr is demonstrated by the room temperature results after thermal exposure - 600° F. for 100 hours. The no exposure room temperature strength properties of 48 ksi yield strength and 60 ksi ultimate strength represent a lower limit of strength properties acceptable for engineering applications. The elevated temperature strength at 600° F. also represents the lower limit of strength of 19 ksi yield strength and 24 ksi ultimate strength.

To further indicate the potential for the Al-Fe-Ni-Cr alloys, two additional product forms, plate and sheet, were fabricated for the Al-4.7Fe-4.7Ni-0.2Cr alloy. The room temperature tension properties for the alloy in the plate and sheet product forms are presented in Table 8. The strength properties of the plate and sheet are consistent with the extrusion data.

The two different compositions of Al-Fe-Ni-Cr which were fabricated along with the three different product forms demonstrate the engineering viability of the material for engineering applications. The upper and lower limits of alloying constituents are represented and verified by the tension properties which have been presented.

TABLE 7

ROOM AND ELEVATED TEMPERATURE TENSION PROPERTIES OF Al—4.7Fe—4.7Ni—0.2Cr (Longitudinal Test Direction)

| | | Extrusion | | | |
|---|---|---|---|---|---|
| Test Temp. | Exposure Conditions | Ultimate Strength, ksi | Yield Strength 0.2% offset, ksi | Elastic Modulus, Msi | Elongation in 1 inch, % |
| Room Temp. | — | 60 | 48 | 12.4 | 11 |
| Room Temp. | 100 hrs at 600 F. | 58 | 49 | 10.4 | 12 |
| 600 F. | 100 hrs at 600 F. | 24 | 19 | 7.9 | 23 |

Data averages of triplicate specimens

TABLE 8

ROOM AND ELEVATED TEMPERATURE TENSION PROPERTIES OF Al—4.7Fe—4.7Ni—0.2Cr FOR SHEET AND PLATE PRODUCT FORMS (Longitudinal Test Direction)

| Product Form | Test Temp. | Exposure Conditions | Ultimate Strength, ksi | Yield Strength, 0.2% offset, ksi | Elastic Modulus, Msi | Elongation in 1 inch, % |
|---|---|---|---|---|---|---|
| Plate | Room Temp | — | 58 | 46 | 12.1 | 14 |
| | Room Temp | 100 hrs at 600 F. | 58 | 48 | 11.0 | 10 |

TABLE 8-continued

ROOM AND ELEVATED TEMPERATURE TENSION PROPERTIES OF Al—4.7Fe—4.7Ni—0.2Cr FOR SHEET AND PLATE PRODUCT FORMS (Longitudinal Test Direction)

| Product Form | Test Temp. | Exposure Conditions | Ultimate Strength, ksi | Yield Strength, 0.2% offset, ksi | Elastic Modulus, Msi | Elongation in 1 inch, % |
|---|---|---|---|---|---|---|
| | 600 F. | 100 hrs at 600 F. | 21 | 15 | 7.2 | 22 |
| Sheet | Room Temp | — | 61 | 51 | 11.1 | 7 |
| | Room Temp | 100 hrs at 600 F. | 58 | 48 | 11.3 | 6 |
| | 600 F. | 100 hrs at 600 F. | 22 | 16 | 6.4 | 19 |

Data averages of triplicate specimens

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The alloy has application as a structure material, requiring high strength and stiffeners particularly in locations on aircraft exposed to elevated temperatures.

We claim:

1. A hot worked aluminum base alloy powder article consisting essentially of 81 to 91.9 percent aluminum, 4 to 8 percent iron, 4 to 8 percent nickel, and 0.1 to 3 percent chromium.

2. The aluminum base alloy of claim 1 wherein the preferred nominal composition is 86 percent aluminum, 6 percent iron, 6 percent nickel and 2 percent chromium.

* * * * *